US012397337B2

(12) United States Patent
Winton, III

(10) Patent No.: US 12,397,337 B2
(45) Date of Patent: Aug. 26, 2025

(54) CRIMPING DEVICE

(71) Applicant: Winton Machine Company, Suwanee, GA (US)

(72) Inventor: George R. Winton, III, Lawrenceville, GA (US)

(73) Assignee: Winton Machine Company, Suwanee, GA (US)

( * ) Notice: Subject to any disclaimer, the term of this patent is extended or adjusted under 35 U.S.C. 154(b) by 70 days.

(21) Appl. No.: 18/081,930

(22) Filed: Dec. 15, 2022

(65) Prior Publication Data

US 2024/0198407 A1 Jun. 20, 2024

(51) Int. Cl.
*B21D 15/06* (2006.01)
*B21D 7/02* (2006.01)

(52) U.S. Cl.
CPC ..... *B21D 15/06* (2013.01); *B21D 7/02* (2013.01)

(58) Field of Classification Search
CPC ..... B21D 7/02; B21D 15/06; B21D 17/02; B21D 7/16; B21C 37/156; B21C 37/158; B21C 37/205
See application file for complete search history.

(56) References Cited

U.S. PATENT DOCUMENTS 1,875,186 A * 8/1932 Tilp ..... B21D 9/14 72/30.1
2,543,480 A 2/1951 Vaill ..... B21D 41/02
2,650,636 A * 9/1953 Jennings, Jr. ..... B21D 9/073 72/154
3,650,140 A * 3/1972 Zmuda ..... B21D 7/022 72/369
3,861,184 A * 1/1975 Knudson ..... B21D 9/14 72/30.1
4,385,514 A * 5/1983 Sassak ..... B21D 39/04 30/96
4,779,436 A * 10/1988 Schwarze ..... B23K 26/0838 72/149
5,768,935 A * 6/1998 Owens ..... B21D 39/048 29/237
6,170,313 B1 * 1/2001 Vasseur ..... B21D 22/04 29/560
6,505,493 B2 * 1/2003 Nakane ..... B21D 17/02 72/370.04
6,854,313 B2 * 2/2005 Knudson ..... B21D 11/08 72/370.04
7,121,626 B2 * 10/2006 Akehi ..... B60N 2/818 297/410
9,636,734 B2 * 5/2017 Baudy ..... B60N 2/818
2005/0210947 A1 * 9/2005 Nagasono ..... B21D 17/04 72/220

(Continued)

FOREIGN PATENT DOCUMENTS

CN 108188231 A * 6/2018
DE 202004006708 U * 6/2004

(Continued)

*Primary Examiner* — Edward T Tolan
(74) *Attorney, Agent, or Firm* — Stein IP LLC

(57) ABSTRACT

A machine used in tube fabrication, wherein the machine imparts a locating feature near an end of a tube when the tube is located between a clamp die and a bend die of the machine by using a crimp die to form detents and bulges in the tube. The locating feature enables the tube to be located in a larger tube.

12 Claims, 13 Drawing Sheets

(56) References Cited

U.S. PATENT DOCUMENTS

| | | | | |
|---|---|---|---|---|
| 2007/0089873 | A1* | 4/2007 | Beste | F28F 1/426 165/177 |
| 2008/0209975 | A1* | 9/2008 | Zinelli | B30B 7/04 72/352 |
| 2016/0023259 | A1* | 1/2016 | Jaubert | B21D 7/021 72/157 |
| 2021/0002749 | A1* | 1/2021 | Christophliemke | C22C 38/12 |

FOREIGN PATENT DOCUMENTS

| | | | | |
|---|---|---|---|---|
| IT | UD930185 | A1 | | 9/1993 |
| KR | 100566513 | B1 | * | 3/2006 |
| KR | 20150026809 | A | * | 3/2015 |

* cited by examiner

CRIMPING DEVICE

FIELD OF INVENTION

Aspects of the present invention relate to tube fabrication and specifically an innovative device used to deform the end of a tube.

BACKGROUND-DESCRIPTION OF THE RELATED ART

In the manufacture of heat transfer devices, it is common to join a large tube (header) to a smaller tube. It is common to find the physical relation of these two tubes to be ninety degrees apart when joined. When joining, the smaller tube is inserted into a hole in the larger tube. When doing so, manufacturers often impart a bead (locating device) on the end of the smaller tube to help set the position (depth) of the smaller tube when it is being inserted into the larger tube. The bead, located on the smaller tube, prevents the smaller tube from extending too far into the larger tube. The function of the bead becomes a locating feature on the smaller tube. Once the smaller tube is in position, the two tubes are typically brazed together to form a low-pressure type of seal.

With the absence of the bead formed on the end of the smaller tube, it is possible for the smaller tube to be inserted too far into the larger tube. If this were to occur, then once the two tubes were brazed together, the smaller tube could become an obstruction to fluid flowing through the larger tube. This would not be desirable. Thus, the need for a locating feature on the end of the smaller tube.

The process of forming a bead on the end of a smaller tube and using this locating device to position the smaller tube relative to a larger tube is widely used in the manufacturing of air conditioning units. In this environment, copper and aluminum tubes are widely used to control the flow of gases and liquids. Joining a smaller tube to a larger tube has been at the very heart of building a reliable air conditioning system.

To impart the bead on the smaller tube, it is common in industry to first place the end of the smaller tube in an end forming machine. Once inserted, the end forming machine will clamp the smaller tube in position using a clamp. Then a ram tool can impart a bead on the end of the smaller tube. Once formed, the ram tool will retract, the clamp will open, and the smaller tube can then be removed from the end forming machine. The whole process could take 2 to 6 seconds to accomplish. This processing time only accounts for the forming process itself. If the end forming machine is part of a larger forming system including other forming machines, time must then be allocated to transport the smaller tube to and from the end forming machine. This could add 2 to 5 seconds to the already 2 to 6 seconds processing time.

A machine that is capable of sending a tube over to an end forming machine is described by Application number ITUD930185 submitted to the Ministry of Industry, Commerce, and Trade Central Patents Office—Rome in 1993. In this application, the system can straighten, cut, end form, and bend a tube all from a bulk coil of tubing. Although ITUD930185 does not speak of end forming the tube specifically, the process of straightening, cutting, end forming, and bending are common in this type of equipment throughout the tube fabrication industry. For example, the machine described in ITUD930185 can easily transport a tube to an end forming machine, form a bead on the end of a tube, and then retract the tube back to the main system for further processing.

During the forming process of a tube as described in ITUD930185, the forming system is capable of partially scoring the tube using a precise cutting process. This scored section of the tubing then propagates forward towards the bend tooling. Once the scored section of the tube becomes flush with a clamp die, the bend tooling is capable of separating the formed part from the rest of the bulk material by applying a concentrated force on the tube in the area of the score. This concentrated force snaps off a previously formed part leaving the leading edge of the bulk tubing available for further processing.

ITUD930185 then has the option of advancing this leading edge forward to an end forming machine where it can form a bead on the leading end of the tubing. This advancing motion of the tubing takes time.

The machine described by ITUD930185 can straighten, bend, and cut a piece of tubing from a single bulk spool of tubing. This machine, and many other machines in this field of tube fabrication are capable of doing the same.

Vaill in U.S. Pat. No. 2,543,480 describes a ram type end forming machine suitable for forming a bead on the end of a tube. In Vaill, a clamp is used to secure the tube. Once secured, a ram type device pushes a forming tool into the end of the clamped tube to form a specific feature. This is the same type of process that would be found to work in conjunction with ITUD930185. The machine described by ITUD930185 would automatically move a tube over to the end forming machine described by Vaill for forming a locating feature on the end of a tube.

The function of the bead is critical. It ensures that the smaller tube is not inserted too far into the larger tube. It is the increase in cross section of the outside diameter (the bead) of the tube that prevents the smaller tube from extending too far into the larger tube. Specifically, the cross section of the smaller tube increases in the area of the bead. This larger cross section of the smaller tube provides for an obstruction near the end of the smaller tube. As the smaller tube is inserted into the opening (hole) of the larger tube, the larger cross section of the bead formed on the smaller tube eventually prevents the smaller tube from extending too far into the larger tube. Thus, the beaded feature on the end of the smaller tube serves the purpose of a locating mechanism.

When forming a bead on the end of the smaller tube, a manufacturer must allow for an additional straight length to a preformed blank of the tube itself. To form the bead, the end of the smaller tube is put in compression along the axis of the smaller tube. With enough axial compressive force on the end of the smaller tube, the smaller tube will buckle in a controlled manner and thus a bead is formed. Once formed, the overall length of the tube is shorter as material was consumed to form the bead.

One of the disadvantages of the current process of forming a bead on the end of a tube is that it takes time to transport the tube to and from an end forming machine. The locating feature of a traditional bead itself cannot be conveniently formed within the envelope of the bend tooling. Therefore, it is necessary for the tube bending machine to first move the tube forward to a traditional tube end forming machine where a bead can then be imparted on the leading end of the tube. Once the bead is formed on the leading end of the tube, the tube can then be pulled back to the tube bending machine for further processing. The disadvantage here is that time is required to move the tube forward to and then back from the end forming machine.

Another disadvantage is that to form a traditional bead on the end of a tube, the overall straight length of the tube prior to forming the bead must be longer. This additional length required to form a bead adds additional cost to the process.

None of the current tube fabrication processes allow a locating feature to be formed on the end of a tube that will serve the function of a traditional bead and at the same time allow this feature to be formed between a bend die and a clamp die.

Moreover, none of the current tube fabrication processes allow a locating feature to be formed on the end of a tube and not require additional raw material just to form the locating feature itself.

Aspects of the current invention make use of a simple powered device to efficiently form a locating feature on the end of a tube all within the envelope of the bend tooling. By doing do, time and material are saved.

SUMMARY OF THE INVENTION

Accordingly, several objects and advantages of my invention are:

- to reduce the overall cycle time required to impart a locating feature on the end of a tube that will prevent the tube from entering too far into a mating larger tube;
- to form a locating feature on the end of a tube all within the cavity between the bend die and the clamp die (envelope of the bend tooling);
- to form a locating feature on the end of a tube without advancing the tubing to a secondary forming system; and
- to reduce the amount of tubing required to form a locating feature on the end of a tube that will act as a locating mechanism during assembly with a larger tube.

Still further objects and advantages will become apparent from consideration of the ensuing description and drawings.

BRIEF DESCRIPTION OF THE DRAWINGS

FIG. 2 shows a larger header tube with a beaded smaller tube on the left and a smaller tube on the right that exhibits locating features on one end that help locate the smaller tube in relation to the larger tube;

FIG. 4 also shows two features on the circumference of the smaller tube that protrude inward;

FIG. 6 is a right angle projection of FIG. 5;

FIG. 11 shows the opening where a small tube would protrude (tube cavity) between a clamp die and a bend die;

FIG. 13 shows the opening (cavity) where a small tube would protrude between a clamp die and a bend die. In this view, the left V of the crimp die is exposed within the tube cavity;

FIG. 15 shows the opening where a small tube would protrude between a clamp die and a bend die. In this view, the right V of the crimp die is exposed within the tube cavity;

FIG. 19 shows the cavity in the bend die and the cavity in the clamp die. Both cavities allow the crimp die to pass thru both the bend die and the clamp die;

FIG. 24 does not show the tube or the crimp die as does FIG. 19. FIG. 24 shows the slot in the bend die and the slot in the clamp die for which the crimp die travels in the X direction.

DESCRIPTION OF THE PREFERRED EMBODIMENT

Figure 1:
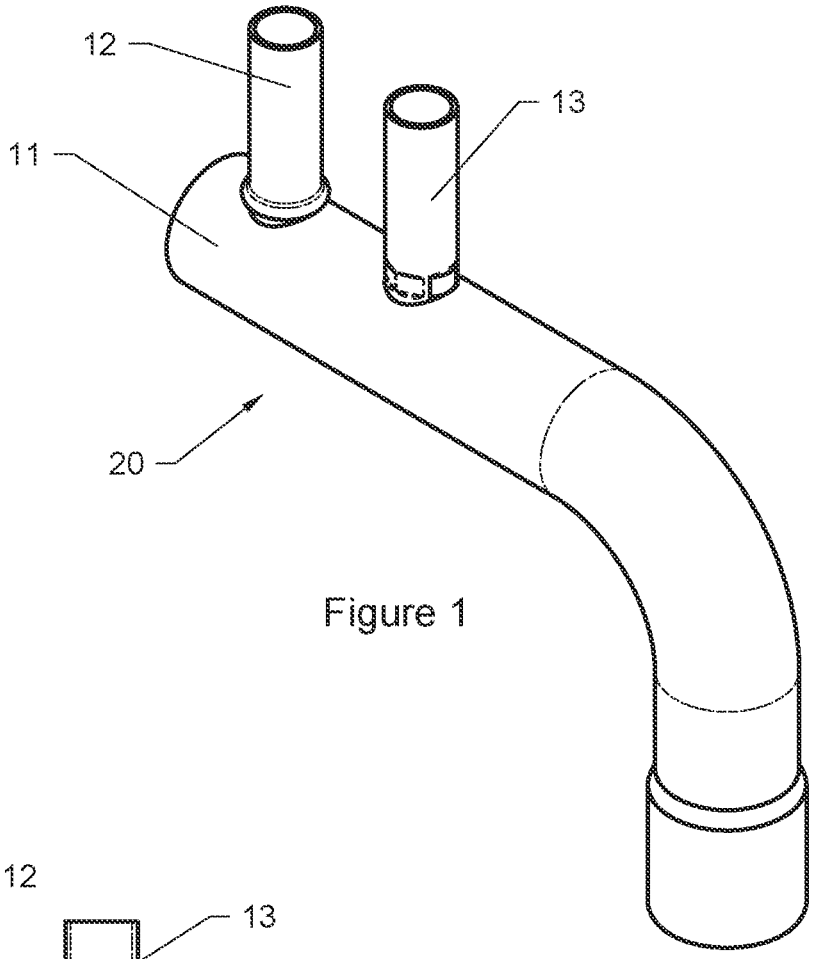
FIG. 1 shows an isometric view highlighting a difference between a traditional beaded small tube on the left and a small tube on the right. The small tube on the right exhibits formed features that help locate the smaller tube in relation to the larger header tube.

FIG. 1, FIG. 2, FIG. 3A, and FIG. 3B all show a comparison between a traditional beaded tube 12 and an alternative tube 13. Tube 12 shows a bead 14 that extends all around the circumference of tube 12. Tube 12 represents related art. This type of locating feature requires a compressive axial force to be applied and thus cannot be provided conveniently within the bend tooling. As an alternative, tube 13 can be formed within the bend tooling. Tube 13 represents a new approach as disclosed in this application. From FIG. 1 and FIG. 3B and others, bulge features 16 and 19 located on tube 13 are sufficient to locate tube 13 relative to tube 11.

Figure 7:
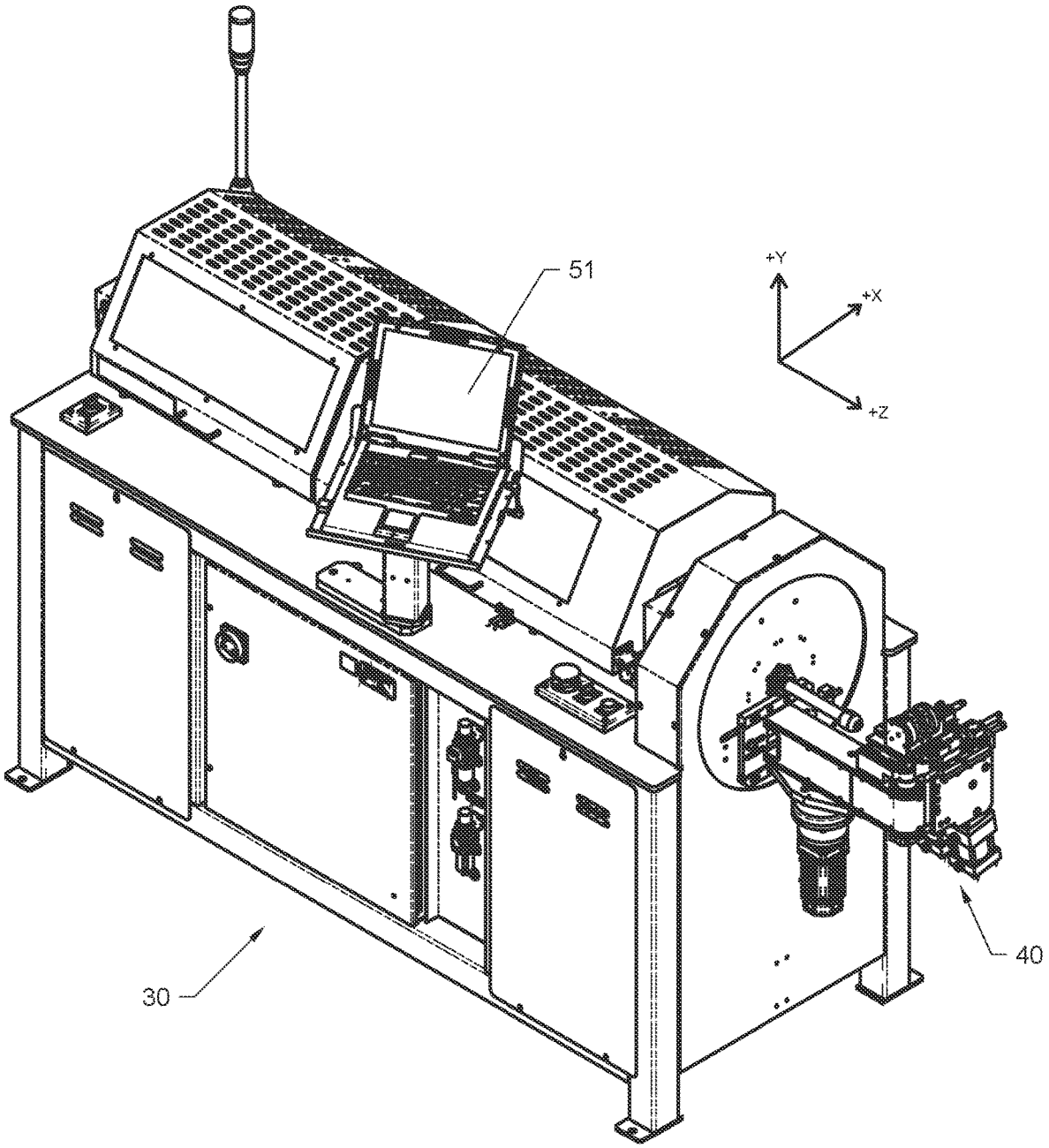
FIG. 7 is an isometric view of a machine that includes a device to form the inventive locating features on a small tube without extending the small tube first in the +Z direction towards and end forming machine.

From FIG. 7, a tube forming machine 30 is shown. Machine 30 contains a computing device, such as a personal computer 51 by way of example, that is used to direct a series of logic devices that makes the machine function. The computing device The computing device may be a cellular phone, a smartphone, a wireless data card, a personal digital assistant (PDA) computer, a tablet computer, a wireless modem, a handheld device, a laptop computer. For ease of description, the devices mentioned above are collectively referred to as computing devices in this application.

Functions of machine 30 may be implemented by at least one of electronic units such as an application-specific integrated circuit (ASIC), a digital signal processor (DSP), a programmable logic device (PLD), a field programmable gate array (FPGA), a processor, a controller, a microcontroller, and/or a microprocessor, or may be implemented by a software module that performs at least one function or operation. The software module may be implemented by using a software program compiled by using any appropriate software language. The software program may be stored in a memory in a mobile device or a network, and is read and executed by a processor.

The processor may be a general-purpose central processing unit (CPU), a microprocessor, an application-specific integrated circuit (ASIC), or one or more integrated circuits configured to control program execution in the solutions of this application.

A memory stores computer readable instructions to control the processor to perform the functions of the machine 50. The memory may be a read-only memory (ROM) or another type of static storage device that can store static information and an instruction, a random access memory (RAM) or another type of dynamic storage device that can store information and an instruction; or may be an electrically erasable programmable read-only memory (EEPROM), a compact disc read-only memory (CD-ROM), or another compact disc storage, optical disc storage (including a compact disc, a laser disc, an optical disc, a digital versatile disc, a Blu-ray disc, or the like), and a disk storage medium or another disk storage device, or any other medium that can be used to carry or store expected program code in a form of an instruction or data structure and that can be accessed by a computer. However, the memory is not limited thereto. The memory may exist independently, and is connected to the processor through the communications line. Alternatively, the memory may be integrated with the processor.

The memory may be a read-only memory (ROM) or another type of static storage device that can store static information and an instruction, or a random access memory (RAM) or another type of dynamic storage device that can store information and an instruction, or may be an electrically erasable programmable read-only memory (EEPROM), a compact disc read-only memory (CD-ROM) or another compact disc storage medium, an optical disc storage medium (including a compressed optical disc, a laser disc, an optical disc, a digital versatile disc, a Blu-ray disc, and the like), a magnetic disk storage medium or another magnetic storage device, or any other medium that can be configured to carry or store expected program code in a form of an instruction or a data structure and that can be accessed by a computer, but is not limited thereto. The memory may exist independently and is connected to the processor by using the communications bus 2021. The memory may alternatively be integrated with the processor 2011.

Figure 8:
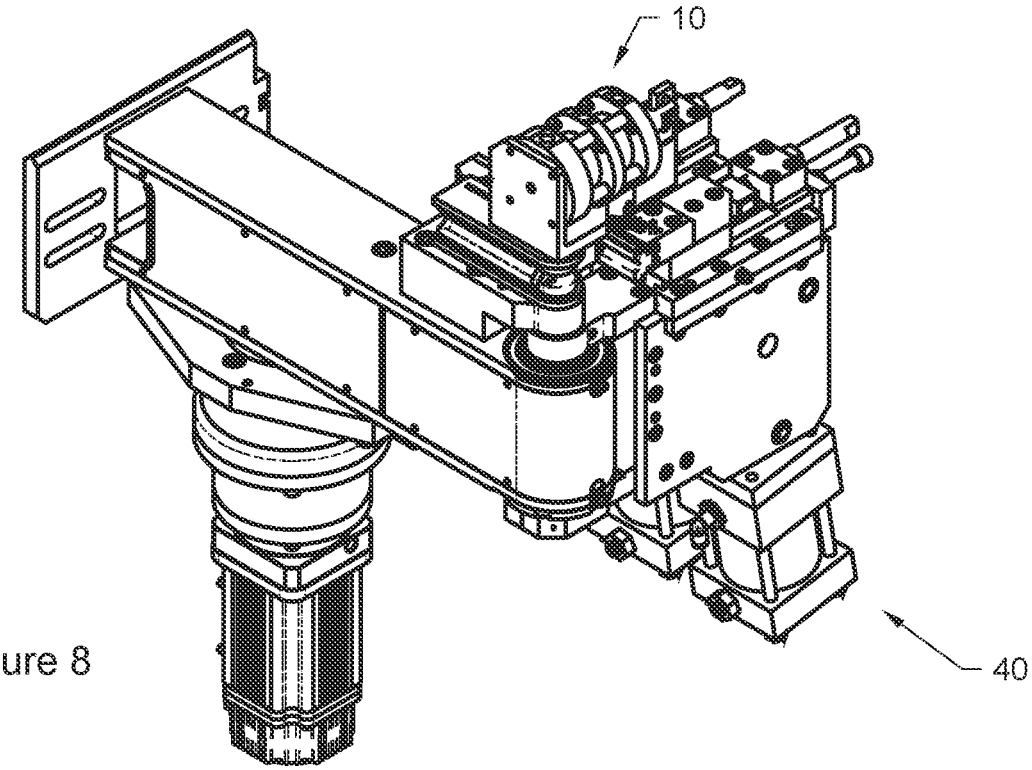
FIG. 8 is a bend head assembly that is part of the machine shown in FIG. 7. The bend head includes a crimping device that is able to form locating features on the end of a small tube. These features will prevent the small tube from being inserted too far into a larger tube.
Figure 9:
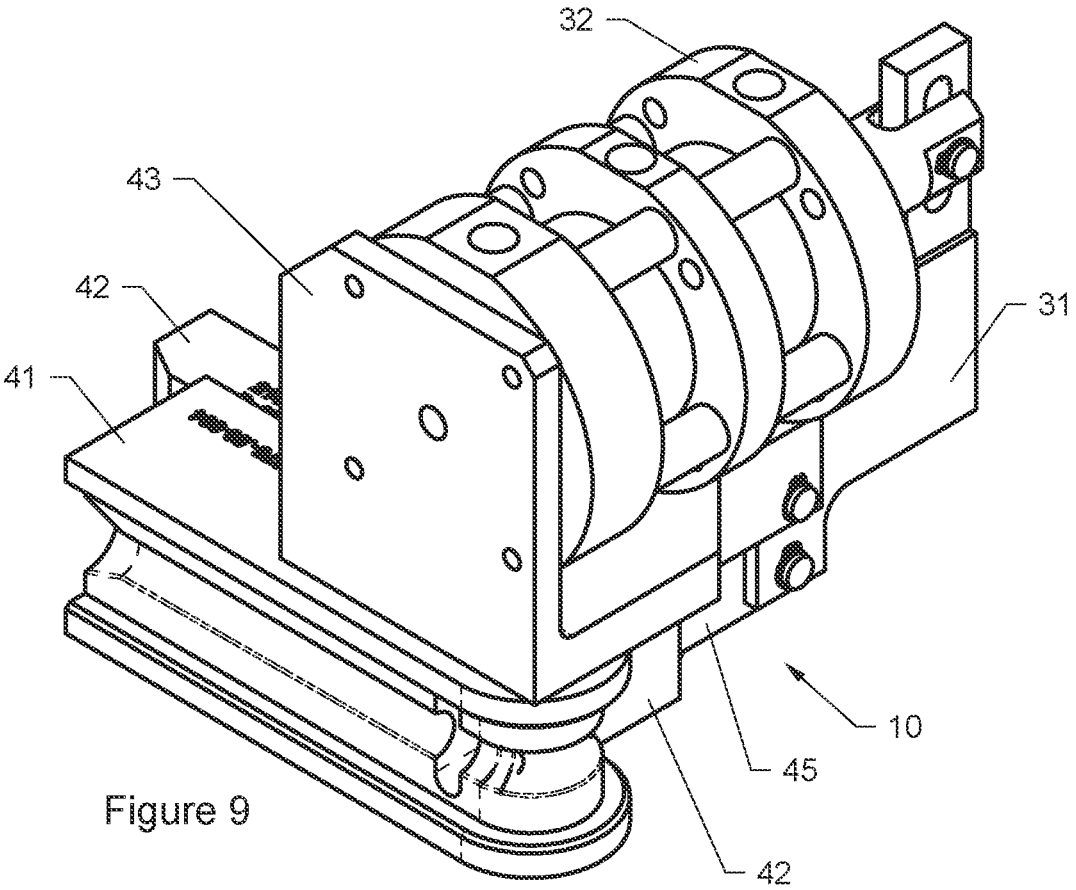
FIG. 9 shows an isometric view of a crimping device that is able to form features on the end of a small tube. These features will prevent the small tube from being inserted too far into a larger tube.
Figure 16:
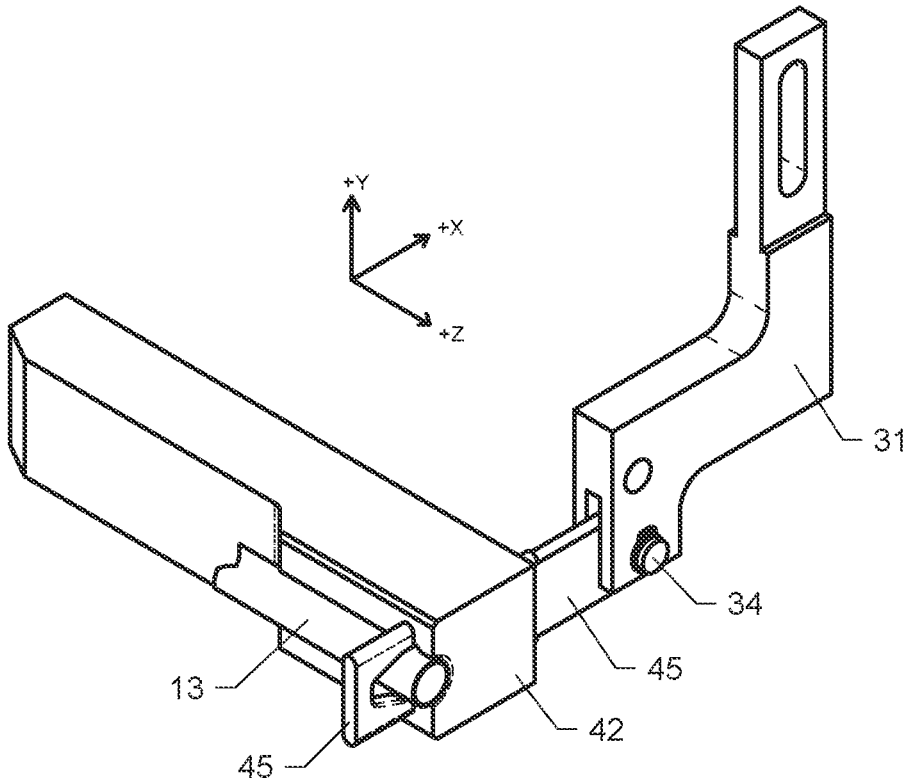
FIG. 16 shows an isometric view of the relationship between the clamp die, crimp die, tube, and pivot arm. The tube moves in the Z direction.

From FIG. 7 and FIG. 16, machine 30 has a tube forming industry standard feeding device for feeding the tube 13 forwards and backwards along the Z axis. This feeding device is well known in the art of tube fabrication so this is not shown in FIG. 7. Machine 30 includes a bend head 40. From FIG. 8, bend head 40 includes a crimping device 10. From FIG. 9, crimping device 10 is attached to a clamp die 42. Adjacent to clamp die 42 is a bend die 41. From FIG. 10, a crimp die 45 is supported by clamp die 42. Crimp die 45 is actuated in the positive X or negative X direction per an actuator arm 31 through slots 46 and 47 in the bend die 41 and clamp die 42, respectively (see FIGS. 16 and 18-23 as well). Actuator arm 31 is rotated about a pivot pin 33 by actuator 32. Actuator arm 31 is connected to crimp die 45 by a pivot pin 34. Actuator 32 is mounted to an actuator bracket 43. Actuator bracket 43 is secured to clamp die 42 by conventional means.

Figure 11:
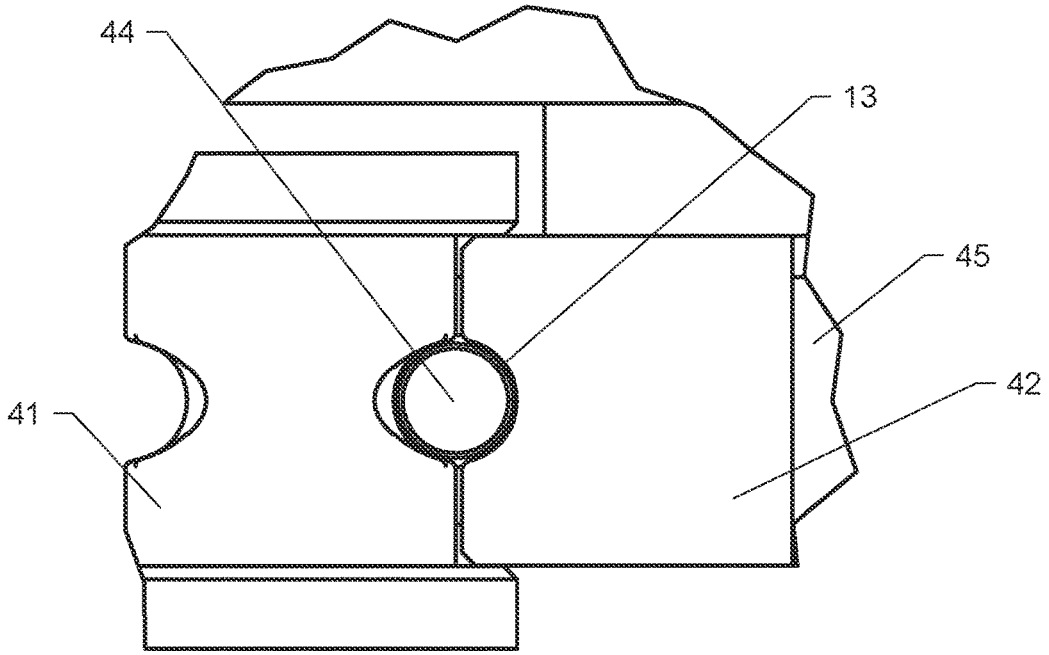
FIG. 11 shows a detailed view of FIG. 10.

From FIG. 11, clamp die 42 and bend die 41 hold captive tube 13. Tube 13 is located in a tube cavity 44. From FIG. 13 and FIG. 23, tube cavity 44 is created by a recess 66 in bend die 41 and a recess 67 in clamp die 42. From FIG. 15 and FIG. 16, tube cavity 44 allows the passage of tube 13 in the Z direction.

Figure 10:
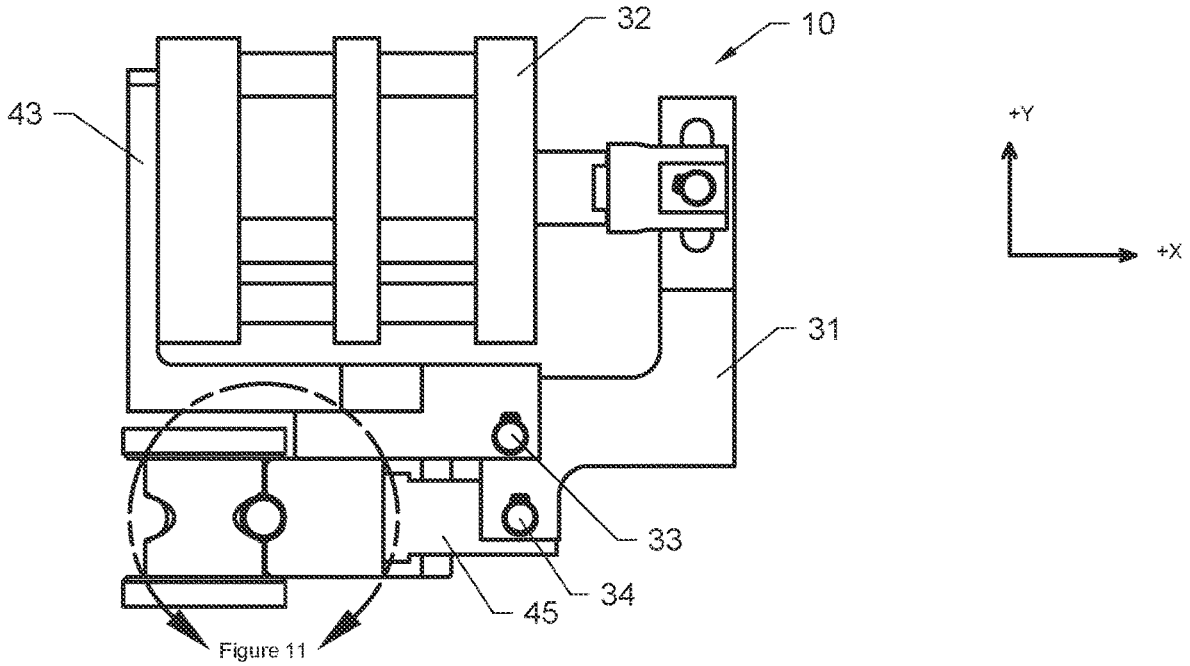
FIG. 10 shows a front view of FIG. 9 with the crimping device positioned in the neutral position.

From FIG. 10, actuator arm 31 is shown in the neutral position. With actuator arm 31 in the neutral position, crimp die 45 is not visible in tube cavity 44.

Figure 12:
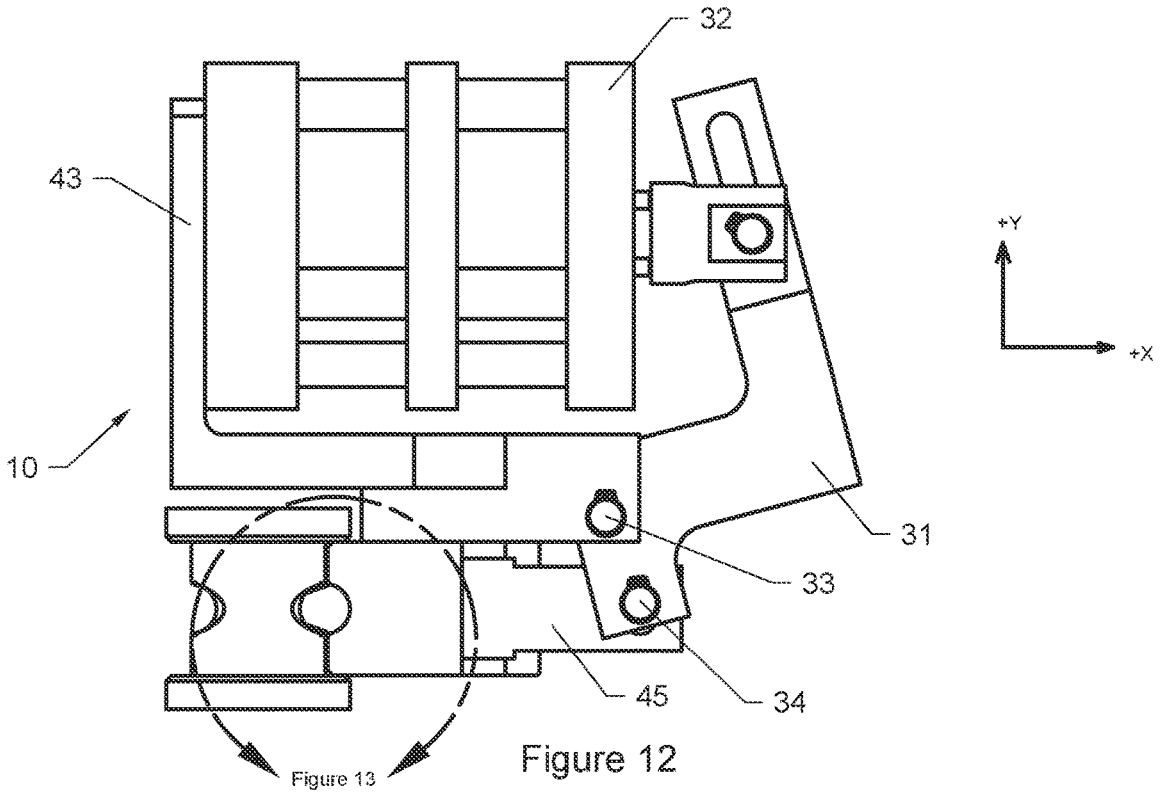
FIG. 12 shows a front view of FIG. 9 with the crimping device sitting in the actuated left position.

From FIG. 12, actuator 32 is shown retracted in the negative X direction. When actuator 32 is retracted, this causes actuator arm 31 to pivot about pivot pin 33 in a counterclockwise direction. From FIG. 13, a crimp die edge 35 and a crimp die edge 36 are exposed in tube cavity 44. Crimp die edge 35 and crimp die edge 36 are part of crimp die 45. The relative angle between crimp die edge 35 and crimp die edge 36 is 40°, but can form an angle in a wider range, such as 20° to 60°, by way of example. Crimp die edge 35 and crimp die edge 36 are exposed in cavity 44 as a result of actuator arm 31 rotated counterclockwise about pivot pin 33.

Figure 14:
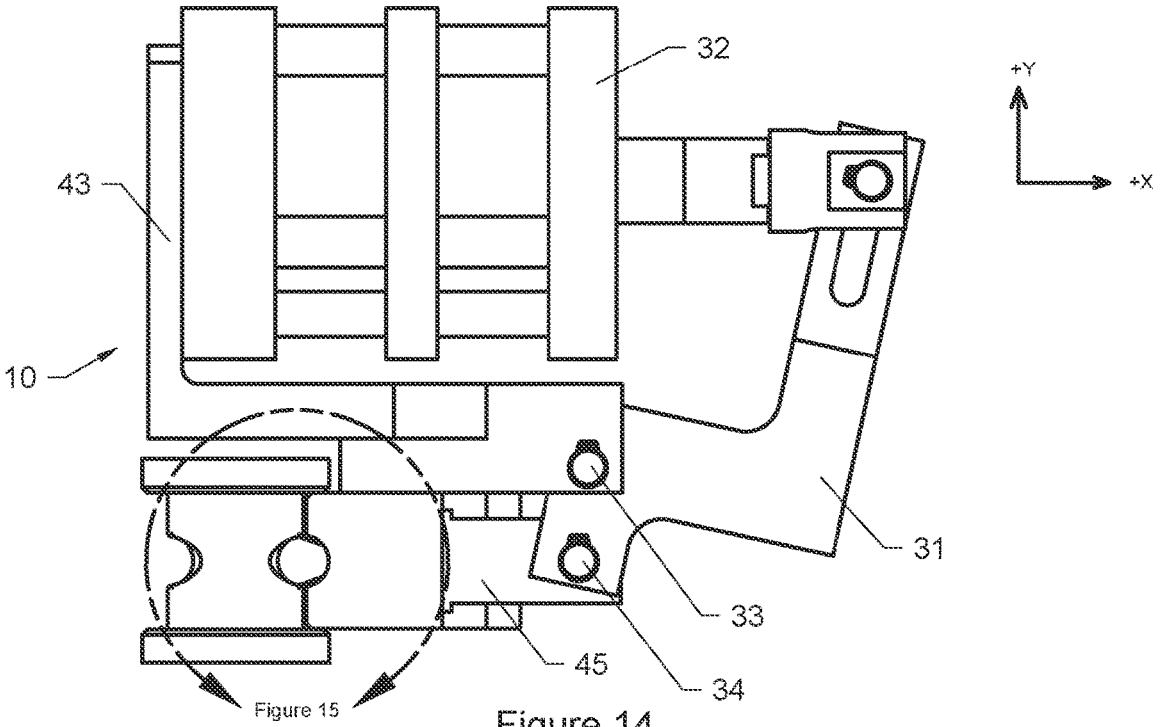
FIG. 14 shows a front view of FIG. 9 with the crimping device sitting in the actuated right position.

Likewise, from FIG. 14, actuator 32 is shown extended in the positive X direction. When actuator 32 is extended, this causes actuator arm 31 to pivot about pivot pin 33 in a clockwise direction. From FIG. 15, a crimp die edge 37 and a crimp die edge 38 are exposed in tube cavity 44. Crimp die edge 37 and crimp die edge 38 are part of crimp die 45. The relative angle between crimp die edge 37 and crimp die edge 38 is 40°, but can form an angle in a wider range, such as 20° to 60°, by way of example. Crimp die edge 37 and crimp die edge 38 are exposed in cavity 44 as a result of actuator arm 31 rotated clockwise about pivot pin 33.

From FIG. 16, tube 13 is shown adjacent to clamp die 42. Tube 13 is also shown to pass thru the opening in crimp die 45. Connected to crimp die 45 is actuator arm 31. It is pivot pin 34 that joins crimp die 45 to actuator arm 31.

Figure 17:
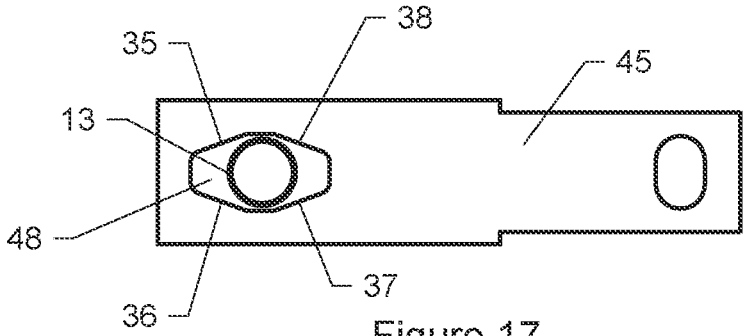
FIG. 17 shows a front view of the crimp die and a tube in what is considered the neutral position of the crimp die with respect to its location to the tube.

From FIG. 17, tube 13 is shown inside a cutout 48 formed in crimp die 45. The cutout 48 in crimp die 45 is defined by crimp edges 35 thru 38.

Figure 18:
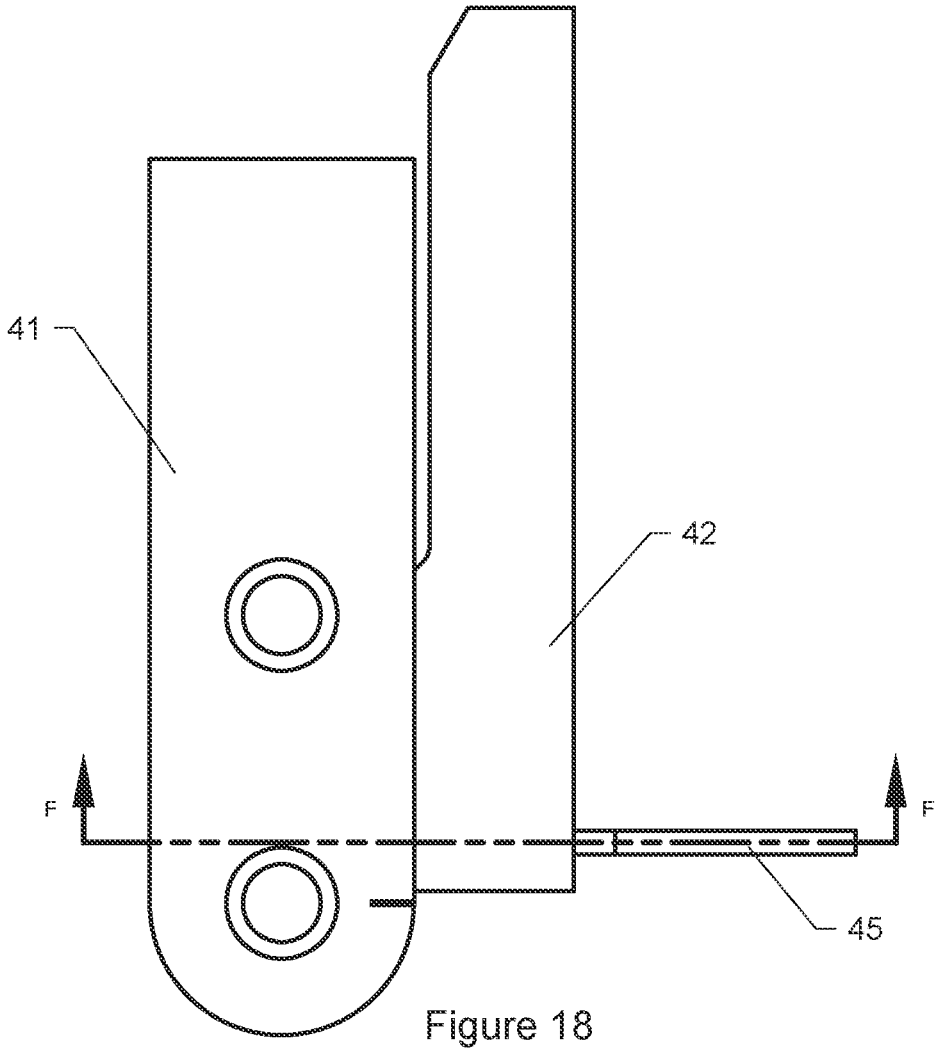
FIG. 18 shows a top view of the bend die, clamp die, and crimp die.

FIG. 18 shows a top view of bend die 41, clamp die 42, and crimp die 45.

Figure 19:
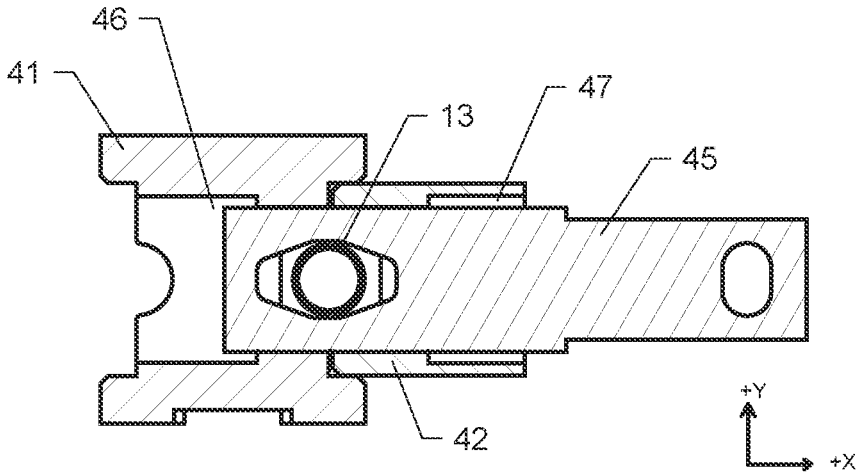
FIG. 19 shows a section view of FIG. 18 along the section line F-F.

FIG. 19 shows a section view of FIG. 18 along the section line F-F.

FIG. 19 shows a slot 46 in bend die 41. FIG. 19 also shows slot 47 in clamp die 42. Crimp die 45 is able to pass through slot 46 and slot 47 in the X direction.

Figure 20:
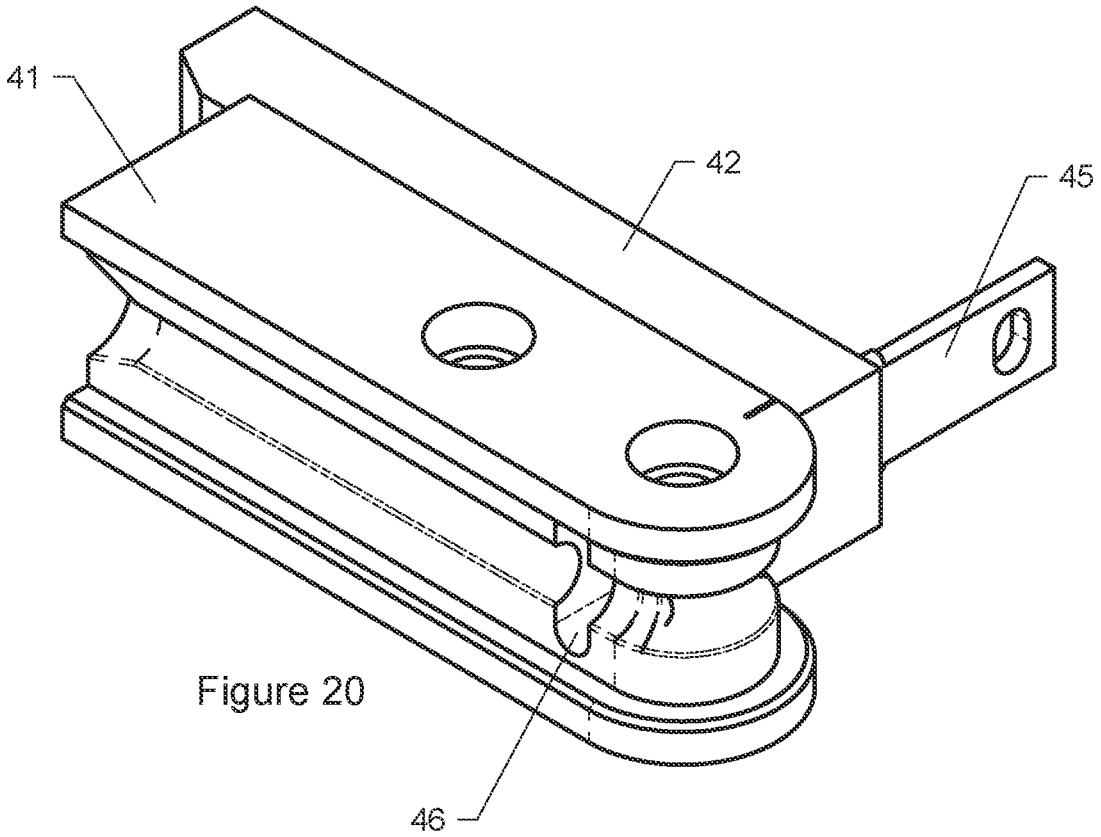
FIG. 20 shows an isometric view of the bend die, clamp die, and the crimp die. The cavity in the bend die is shown. This cavity allows the crimp die to pass thru the bend die.
Figure 21:
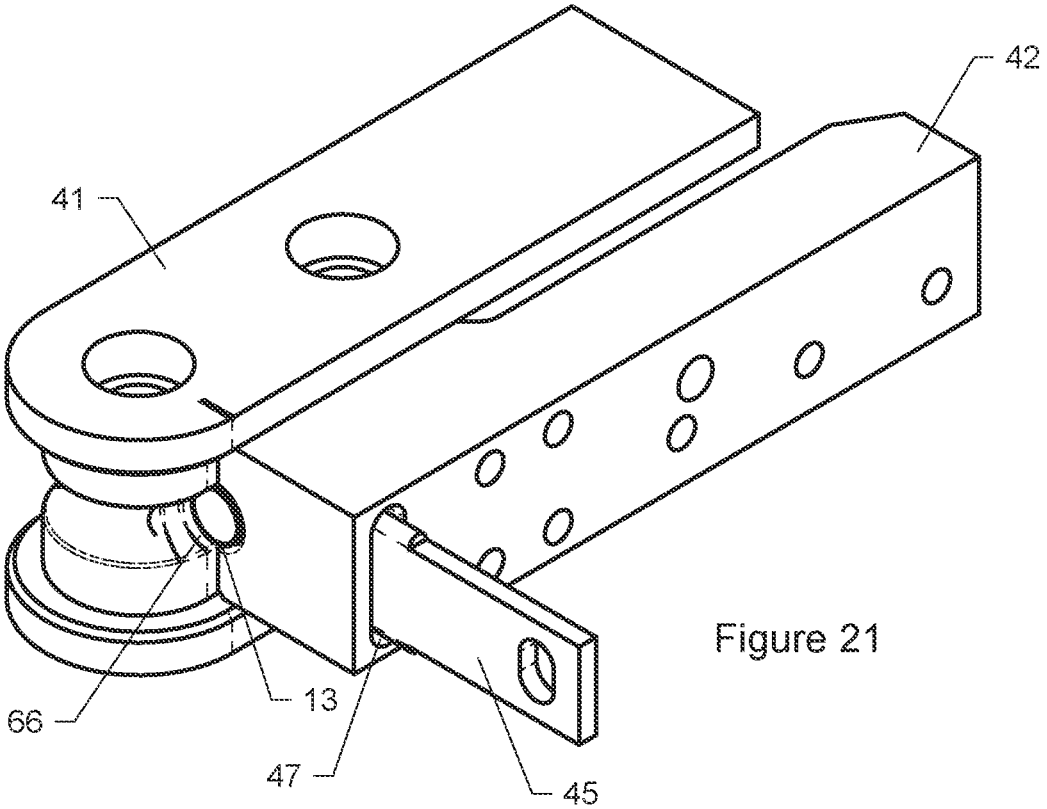
FIG. 21 shows an isometric view of the bend die, clamp die, and the crimp die. In this view the cavity in the clamp die is shown. This cavity allows the crimp die to pass thru the clamp die. This view also shows the end of the tube in relation to the bend die and the clamp die.

FIG. 20 shows slot 46. FIG. 21 shows slot 47. Both slot 46 and slot 47 allow crimp die 45 to pass thru bend die 41 and clamp die 42.

Figure 23:
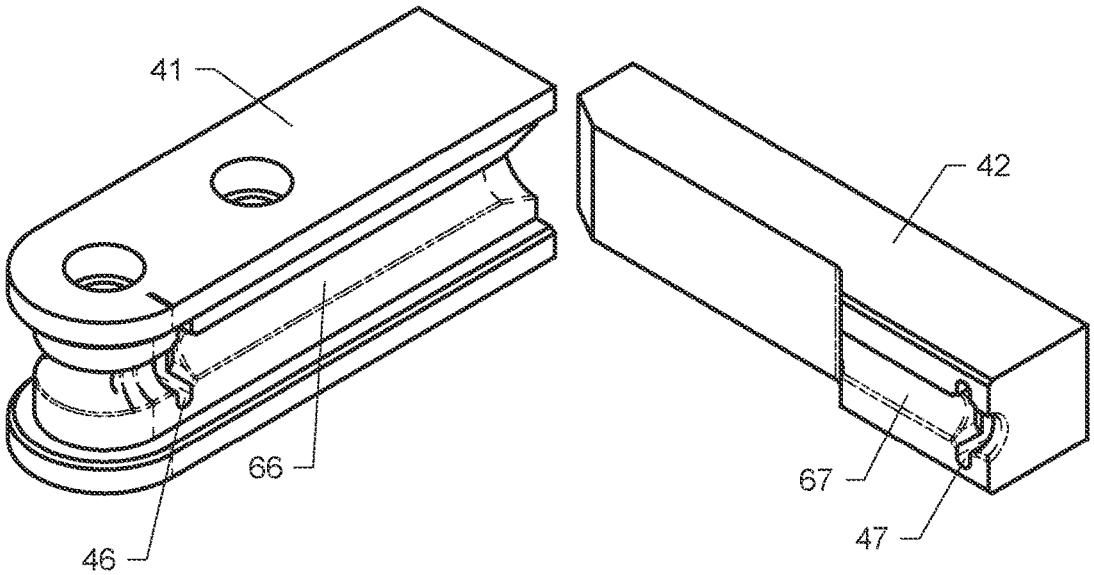
FIG. 23 shows a recess (cavity) in the bend die and a recess (cavity) in the clamp die.
Figure 24:
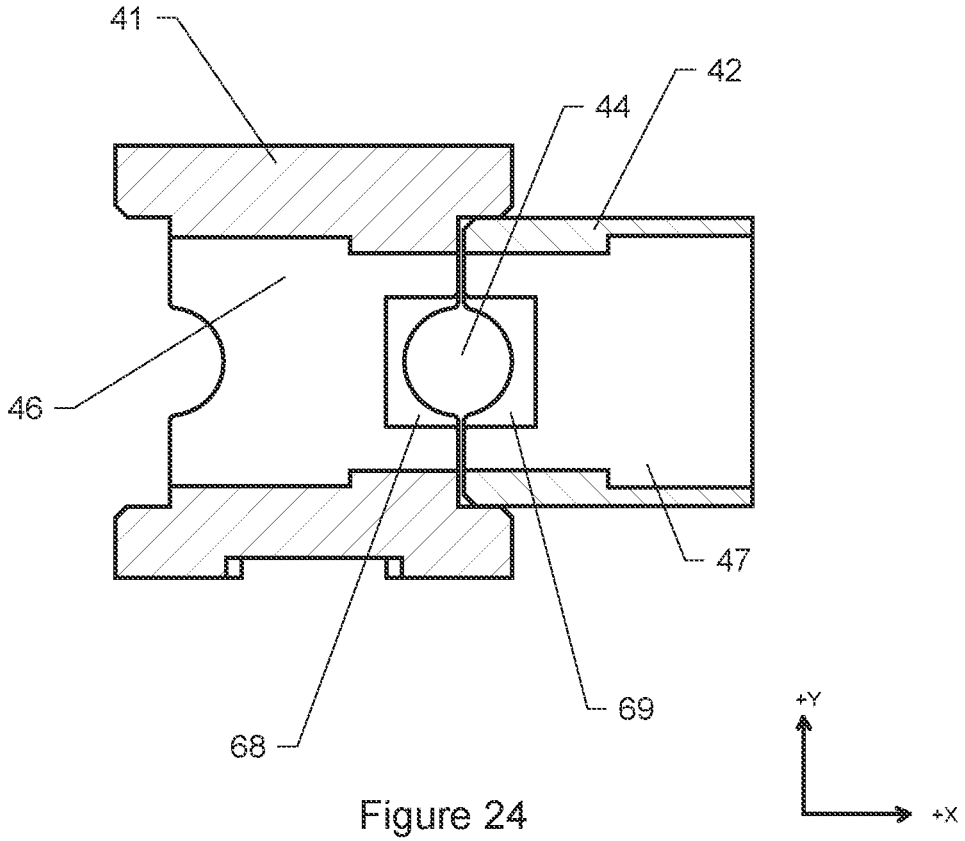
FIG. 24 shows a cross section of FIG. 18 along the line F-F.

From FIGS. 23-24, slot 46 is shown. Slot 46 is adjacent to a cavity 68. Cavity 68 allows bulge 16 room to expand outward away from the center of tube 13. Likewise, slot 47 is shown. Slot 47 is adjacent to a cavity 69. Cavity 69 allows bulge 19 room to expand outward and away from the center of tube 13.

Figure 22:
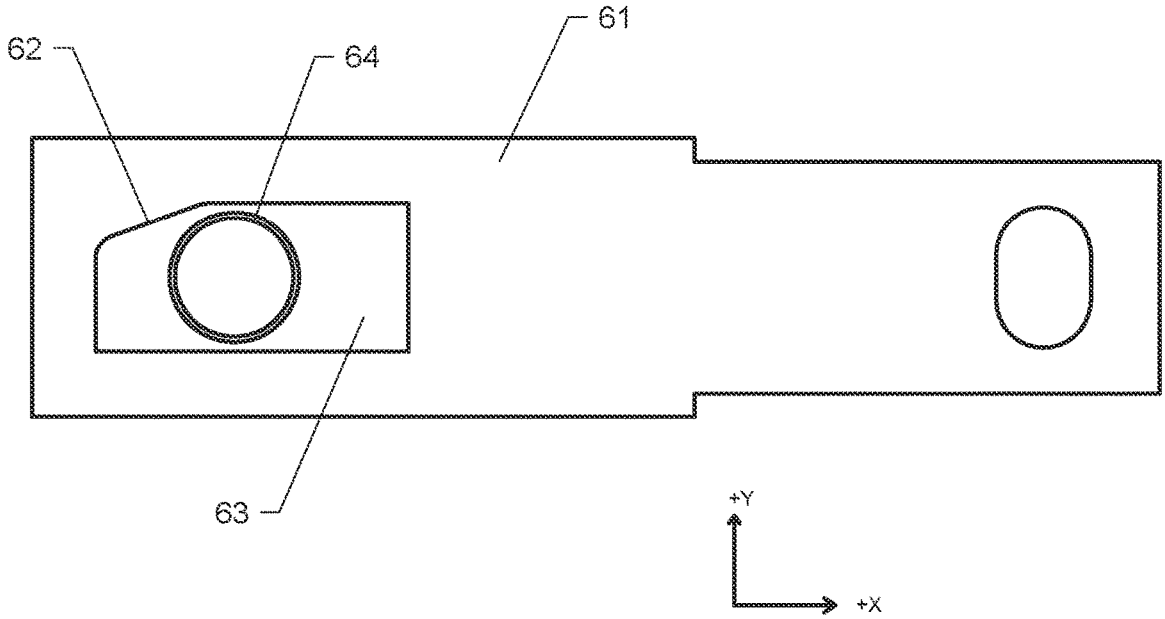
FIG. 22 shows an alternative crimp die. This crimp die displays only one crimping edge. This edge is used to deform (dent) the tube. By denting the tube, the tube then expands outward in another direction. Specifically, by denting the tube, a local area on the circumference of the tube then protrudes outward away from the centerline of the tube. It is this protrusion that limits how far the tube can extend into an opening formed in a larger tube.

FIG. 22 shows an alternative crimp die 61. Crimp die 61 makes use of one crimp edge 62. Crimp edge 62 defines crimp opening 63. Crimp opening 63 formed in crimp die 61. Crimp opening 63 allows a tube 64 to pass thru crimp die 61.

Figure 13:
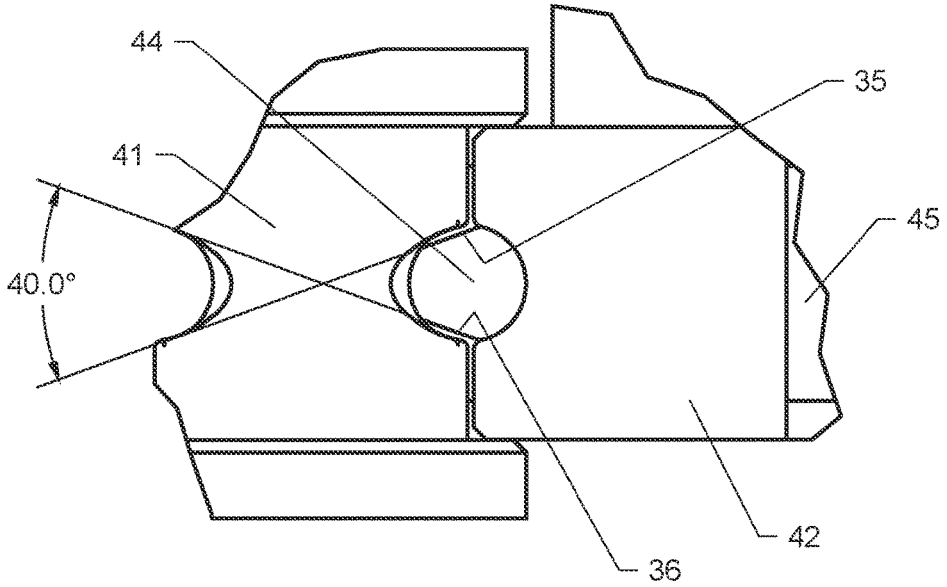
FIG. 13 shows a detailed view of FIG. 12.
Figure 15:
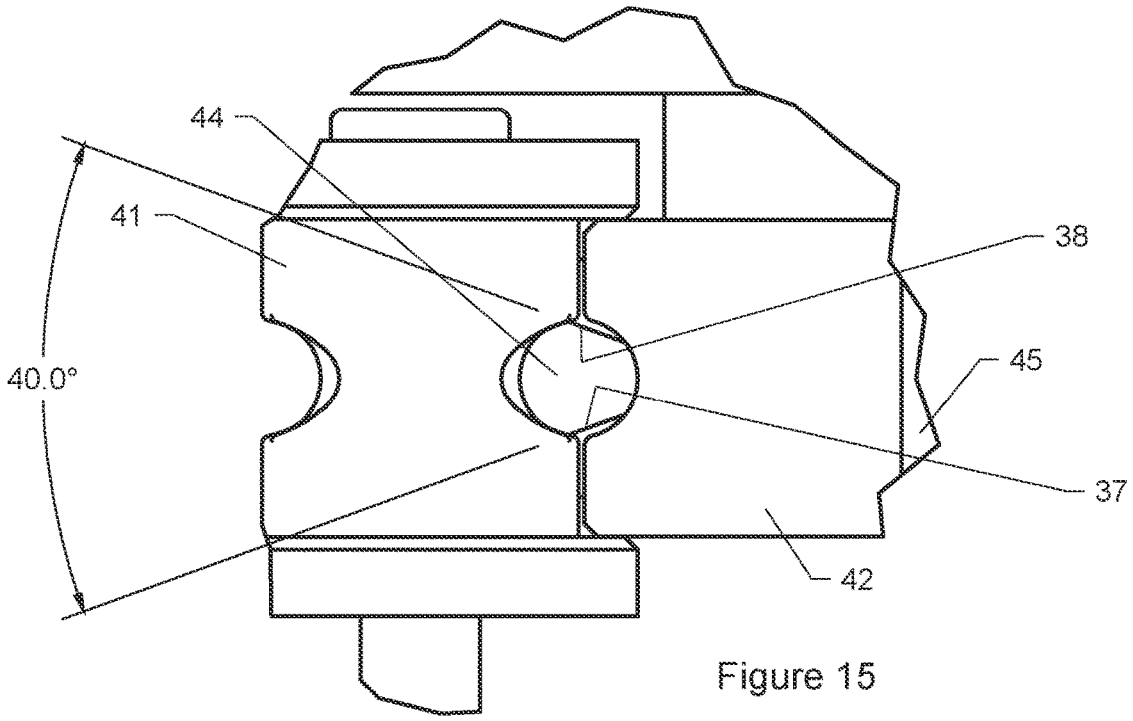
FIG. 15 shows a detailed view of FIG. 14.

In operation, from FIG. 7, machine 30 controls bend head 40. From FIG. 16, With the end of tube 13 sitting as shown, tube 13 is in a position to have a locating feature imparted on its end. The locating feature itself most often is spaced a small distance from the very end of tube 13 The distance might be as small as 0.06 inches and as large as 2 inches, by way of example. With crimping device 10 in the neutral position as shown in FIG. 10, actuator 32 retracts in the negative X direction as shown in FIG. 12 and FIG. 13. With crimp die 45 shifted to the right, crimp die edge 35 and crimp die edge 36 compress on tube 13 against clamp die 42. Then actuator 32 changes position from retracted (FIG. 12) to extended as shown in FIG. 14 and FIG. 15. With actuator 32 extended in the positive X direction, this allows crimp die 45 to shift to the left (negative X direction). When shifted, this allows crimp die edges 37 and 38 to compress on tube 13 against bend die 41.

Figure 3A:
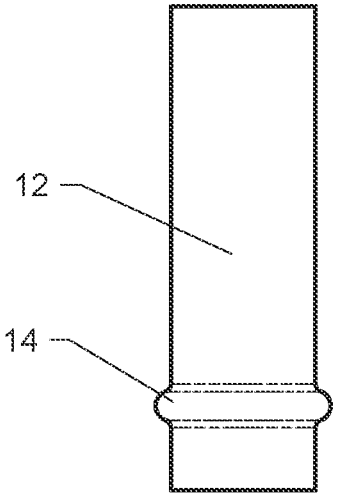
FIG. 3A shows a front view of a smaller beaded tube that shows a traditional bead formed around the circumference of the smaller tube.
Figure 3B:
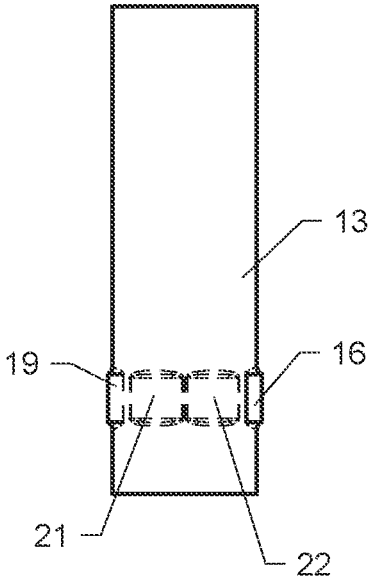
FIG. 3B shows a smaller tube with locating features that protrude outward from the circumference of the smaller tube. These protrusions that extend outward from the circumference of the smaller tube do not extend all the way around the smaller tube as does a bead on a traditional beaded tube. In this case, the protrusions number in two and are 180° apart from one another.
Figure 4:
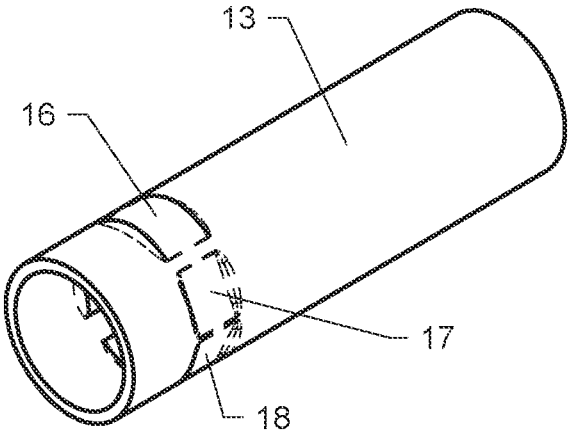
FIG. 4 shows an isometric view of a smaller tube. The smaller tube displays formed features that protrude outward.
Figure 5:
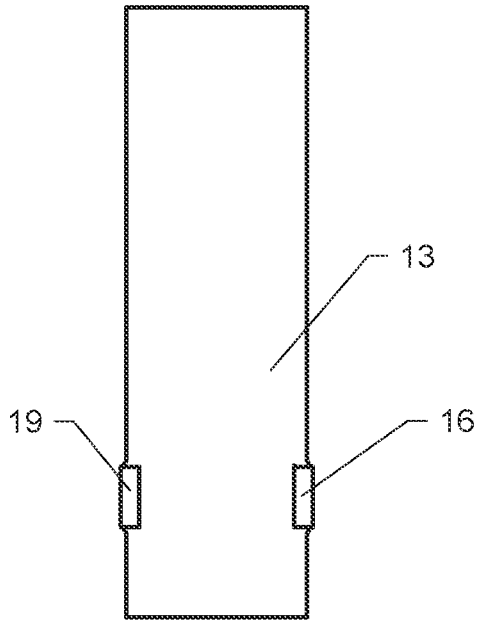
FIG. 5 shows a front view of a smaller tube. The smaller tube displays formed features that protrude outward on both sides beyond the circumference of the smaller tube.
Figure 6:
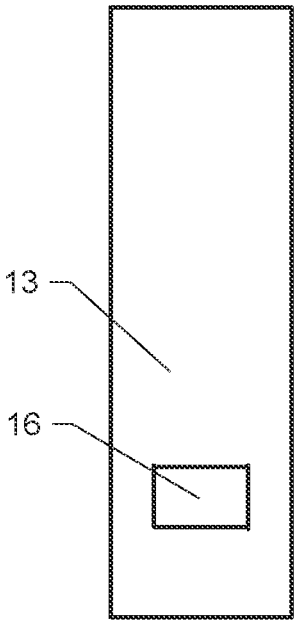
FIG. 6 shows a front view of FIG. 5. The smaller tube displays a locating feature that protrudes outward from of the plane of paper.

From FIG. 17, when crimp die edges 35 thru 38 compress tube 13, this causes tube 13 to deform. From FIG. 10, actuator 32 will extend in the positive X direction. It will also retract in the negative X direction. When doing so, from FIG. 3B and FIG. 4, detents 17, 18, 21, and 22 are formed on tube 13 by crimp die 45. From FIG. 3B and FIG. 4, pushing on tube 13 in the area of detents 17, 18, 21, and 22 will cause the circumference on tube 13 to expand outward as shown in FIG. 3. From FIG. 3B and FIG. 17, bulges 16 and 19 are caused by crimp die 45 pressing in on tube 13 in the area of detents 17, 18, 21, and 22.

From FIGS. 18 thru 24, detents 17, 18, 21, and 22, are formed by crimp die 45 as crimp die 45 travels in the positive X and negative X directions in slots 46 and 47. During this motion of crimp die 45, crimp die 45 is captivated within slot 46 and slot 47 as viewed in the Y and Z directions. It is the voids provided by cavity 68 and cavity 69 that allows the bulges 16 and 19 the room to be formed by crimp die 45.

Figure 2:
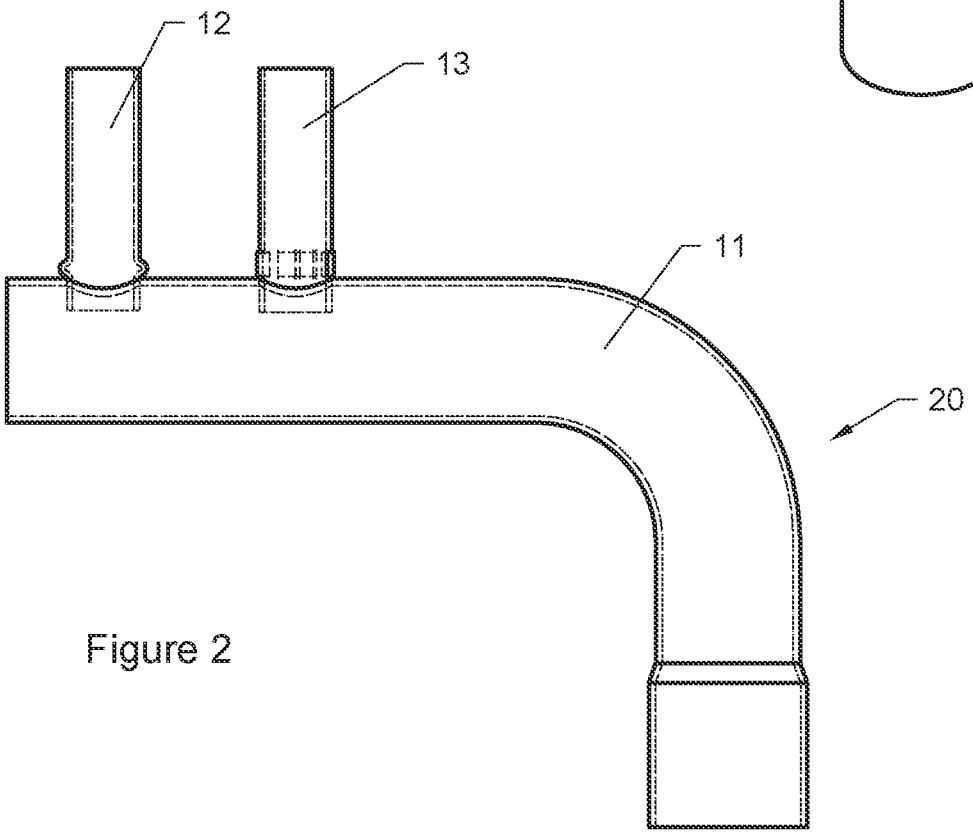
FIG. 2 shows a front view of FIG. 1.

From FIG. 1, FIG. 2, and FIG. 3B, it is bulge 16 and bulge 19 that extend outward from the circumference of tube 13 that allow these features to position tube 13 when installed in tube 11.

From FIG. 3B and FIG. 7, once bulge 16 and bulge 19 are formed on tube 13, a standard feeding device can then move tube 13 forward in the +Z direction. Once tube 13 is advanced in the +Z direction, the bend tooling can then be directed by a microprocessor to form various bends on tube 13 in user defined locations.

From FIG. 22, an alternative crimp die 61 is actuated in the positive X direction. When crimp die 61 moves in the positive X direction, crimp edge 62 formed in a cutout (opening) 63 will deform a tube 64. By deforming (denting) tube 64, tube 64 will be forced to bulge outward or expand radially outward. This bulge (protrusion) will cause tube 64 from being inserted too far into a mating tube.

Other alternatives are possible as well. For example, there may be a second crimp edge underneath the crimp edge 62 so that when the crimp die moves in the positive X direction, a second detent is formed in the tube 64 at the same time. Or there could be another crimp edge to the right (directly or to the right and below) in FIG. 22 of the crimp edge 62 so that a detent is formed when the crimp die 61 moves in the positive X direction, one detent is formed in the tube 62, and when the crimp die 61 moves in the negative X direction, another detent is formed in the tube 62. Other combinations of crimp die edges can be formed at the edge of the cutout 63.

In the present invention, bulges 16 and 19 are formed in tube 13 along the X axis. It is possible to form bulges 16 and 19 along the Y axis or yet at some other angle that is not perpendicular to the X axis. All that would be required is a different style crimp die.

Crimping device 10 could be an all-electric device, hydraulic device, or even a hybrid device involving other crimping processes or other source of power. A goal is to describe a device that can save time and material when joining a smaller tube to a larger tube as is often the case in the manufacturing of products such as air conditioning units for example.

It is possible to conceive of a device where detents 17, 18, 21, and 22 are all imparted on tube 13 at the same time. With additional mechanisms, one or more bulges located on the circumference of a tube can be formed all at the same time. This process can save further processing time. To effect this, additional mechanisms would be required.

Accordingly, the scope of the invention should be determined not by the embodiments illustrated, but by the appended claims and their legal equivalents.

What is claimed is:

1. A machine to put a locating feature in a tube, comprising:

a bend die having a first recess;

a clamp die having a second recess, wherein the first and second recesses are adjacent to each other to form a cavity which enables the tube to pass through the cavity in a Z direction and be held in place, wherein X, Y and the Z directions are perpendicular to each other; and a crimp die movable in the X direction, the crimp die having a first crimp die edge angled relative to the X direction and which puts a first detent in the tube as the crimp die moves in a positive direction along the X direction to create a bulge in the tube extending beyond an outer circumference of the tube;

wherein each of the bend die and the clamp die have a slot through which the crimp die moves in the positive and a negative X direction opposite the positive X direction.

2. The machine according to claim 1, wherein the crimp die has a second crimp die edge, the second crimp die edge is angled relative to the X direction and puts a second detent in the tube as the crimp die moves in a negative X direction along the X direction.

3. The machine according to claim 1, wherein the crimp die has second through fourth crimp die edges, wherein the second through fourth crimp dies edges are angled relative to the X direction, wherein the second crimp die edge puts a second detent in the tube as the crimp die moves in the positive X direction, and the third and fourth crimp die edges put third and fourth detents in the tube as the crimp die moves in a negative X direction along the X direction.

4. The machine according to claim 1, wherein the crimp die comprises an opening, an edge of the opening being the first crimp die edge.

5. The machine according to claim 2, wherein the crimp die comprises an opening, and edges of the opening being the first and second crimp die edges respectively.

6. The machine according to claim 3, wherein the crimp die comprises an opening, and edges of the opening being the first through fourth crimp die edges respectively.

7. The machine according to claim 1, wherein when the crimp die is in a neutral position, the crimp die enables the tube to pass through an opening having the crimp die edge in the crimp die and through the cavity, and when the tube has passed through the opening and the cavity, the crimp die moves in the positive X direction so that the crimp die edge pushes on the tube to form the detent in the tube.

8. The machine according to claim 2, wherein the first and second crimp die edges put the first and second indents in the tube simultaneously.

9. The machine according to claim 3, wherein the first and second crimp die edges put the first and second indents in the tube simultaneously, and the third and fourth crimp die edges put the third and fourth indents in the tube simultaneously.

10. The machine according to claim 2, wherein the first and second detents are located along a same diameter of the tube as each other.

11. The machine according to claim 3, wherein the first through fourth detents are located along a same diameter of the tube as each other.

12. A machine to put a locating feature in a tube, comprising:

a bend die having a first recess;

a clamp die having a second recess, wherein the first and second recesses are adjacent to each other to form a cavity which enables the tube to pass through the cavity in a Z direction and be held in place, wherein X, Y and the Z directions are perpendicular to each other; and a crimp die movable in the X direction, the crimp die having a first crimp die edge angled relative to the X direction and which puts a first detent in the tube as the crimp die moves in a positive direction along the X direction to create a bulge in the tube extending beyond an outer circumference of the tube;

wherein the crimp die has second through fourth crimp die edges, wherein the second through fourth crimp dies edges are angled relative to the X direction, wherein the second crimp die edge puts a second detent in the tube as the crimp die moves in the positive X direction, and the third and fourth crimp die edges put third and fourth detents in the tube as the crimp die moves in a negative X direction along the X direction; and wherein each of the bend die and the clamp die have a slot through which the crimp die moves in the positive and a negative X direction opposite the X direction.

* * * * *